US005390568A

United States Patent [19]

Pietras

[11] Patent Number: 5,390,568

[45] Date of Patent: Feb. 21, 1995

[54] AUTOMATIC TORQUE WRENCHING MACHINE

[75] Inventor: Bernd-Georg Pietras, Wedemark, Germany

[73] Assignee: Weatherford/Lamb, Inc., Houston, Tex.

[21] Appl. No.: 75,687

[22] Filed: Jun. 11, 1993

Related U.S. Application Data

[63] Continuation-in-part of Ser. No. 891,752, Jun. 1, 1992, abandoned.

[30] Foreign Application Priority Data

Mar. 11, 1992 [GB] United Kingdom ..... 9205211

[51] Int. Cl.[6] ..... B25B 13/50

[52] U.S. Cl. ..... 81/57.16; 81/57.24

[58] Field of Search ..... 81/57.15, 57.16, 57.24, 81/57.25, 57.33, 57.34, 57.35, 57.4, 57.41

[56] References Cited

U.S. PATENT DOCUMENTS

| | | | |
|---|---|---|---|
| 2,668,689 | 2/1954 | Cormany | 81/57.18 |
| 3,086,413 | 4/1963 | Mason | 81/57.18 |
| 3,500,708 | 3/1970 | Wilson | 81/57.34 |
| 3,516,308 | 6/1970 | Ham et al. | 81/57.16 |
| 3,760,658 | 9/1973 | Guier | 81/57.33 |
| 3,838,613 | 10/1974 | Wilms | 81/57.15 |
| 4,170,908 | 10/1979 | Peveto et al. | 81/57.11 |
| 4,246,809 | 1/1981 | Keast et al | 81/57.16 |
| 4,402,239 | 9/1983 | Mooney | 81/57.16 |
| 4,423,647 | 1/1984 | Toelke | 81/57.34 |
| 4,492,134 | 1/1985 | Reinholdt et al. | 81/57.34 |
| 4,494,425 | 1/1985 | Shewmake, Sr. | 81/57.34 |
| 4,574,664 | 3/1986 | Curry | 81/57.34 |
| 5,060,542 | 10/1991 | Hauk | 81/57.34 |
| 5,081,888 | 1/1992 | Schulze-Beckingh | 81/57.16 |

FOREIGN PATENT DOCUMENTS

| | | |
|---|---|---|
| 1239634 | 7/1988 | Canada . |
| 0194956 | 9/1986 | European Pat. Off. . |
| 0339005 | 10/1989 | European Pat. Off. . |
| 2511353 | 3/1974 | Germany . |
| 38987.78 | 10/1978 | United Kingdom . |
| WO8200428 | 2/1982 | WIPO . |
| WO9006418 | 6/1990 | WIPO . |
| WO9218743 | 10/1992 | WIPO . |

OTHER PUBLICATIONS

"General Services and Products Catalog, 1990–91" Weatherford, 1989.

"Integral Back Up Tongs," Weatherford, Feb. 1985.

"Well Completion Component Test Facilities," KSEPL, 1986, p. 12.

"Instruction Manual For Hydraulic Back Up Tong Integrally Mounted on 7 $\frac{5}{8}$" GMBH Tong," Weatherford, Jan. 1981.

"Varco Oil Tools," Composite Catalog, 1982–83, pp. 8378–8382.

"Joy Petroleum Equipment Group," Composite Catalog, 1982–83, pp. 5082–5083.

"Eckel Tongs Back Up Units," Composite Catalog, 1982–82, p. 953.

"General Services And Products Catalog 1988–89" Weatherford, pp. 26–28.

*Primary Examiner*—D. S. Meislin

*Attorney, Agent, or Firm*—Guy McClung

[57] ABSTRACT

An automatic torque wrenching machine comprises a frame having a support member which can be raised and lowered by admitting air to or allowing air to leave a pneumatic bellows. A tong assembly is suspended from the support member by four ties comprising wire ropes each of which is provided with a spring. The pneumatic bellows allows pipes to be connected and disconnected with minimal risk of damage to the threads. In addition, the ties enable the tong assembly to float in a generally horizontal plane relative to the frame.

15 Claims, 5 Drawing Sheets

AUTOMATIC TORQUE WRENCHING MACHINE

RELATED APPLICATION

This is a continuation-in-part of U.S. application Ser. No. 07/891,752, filed Jun. 1, 1992, of the same title now abandoned.

FIELD OF THE INVENTION

This invention relates to automatic torque wrenching machines.

BACKGROUND OF THE INVENTION

Automatic torque wrenching machines are now being used on off-shore drilling platforms to obviate the need for skilled personnel in the highly hazardous area of the rig floor.

Typically, such automatic torque wrenching machines are used to make-up and break out joints in pipes which may be up to 500mm in diameter.

During a make-up operation it is necessary to bring the threaded end (often referred to as the "pin") of one pipe, for example a length of casing, into contact with a threaded socket on the pipe below. The pipes must then be rotated relative to one another until the joint reaches the desired torque.

Because of the substantial weight of the upper pipe it is necessary to support the pipe until the connecting operation is complete to ensure that the weight of the pipe does not damage the threads.

To achieve such jointing it has been proposed to grip the lower pipe with a back-up tong, to grip the upper pipe with a power tong and to provide an advancing mechanism which, as the power tong rotates the upper pipe with respect to the lower pipe lowers the power tong towards the back-up tong.

Whilst this arrangement works tolerably well it has been found necessary to, employ a skilled worker close to the automatic torque wrenching machine to ensure that the thread of the upper pipe initially engages the thread of the socket on the lower pipe correctly. If correct initial engagement does not occur then the advancing mechanism moves the power tong towards the back-up tong prematurely thus damaging the thread.

SUMMARY OF THE INVENTION

According to one aspect of the present invention there is provided an automatic torque wrenching machine for coupling and uncoupling threaded length of pipe, said automatic torque wrenching machine comprising a back-up tong for gripping a first length of pipe, a power tong for gripping a second length of pipe and rotating said second length of pipe relative to said first length of pipe, means connecting said power tong and said back-up tong to transmit reaction forces from said power tong to said back-up tong, means for moving said power tong towards and away from said back-up tong, the improvement comprised in that said means for moving said power tong towards and away from said back-up tong comprises a pneumatic operator, and means for admitting gas to said pneumatic operator to increase the pressure therein, and means for allowing gas to leave said pneumatic operator.

Preferably, said automatic torque wrenching machine includes a frame and a support member, characterized in that said power tong is supported from said support member, and said pneumatic operator is connected to said frame and said support member whereby said support member can be raised and lowered relative to said frame.

In one embodiment said back-up tong is suspended from said power tong.

Advantageously, said power tong is supported by at least three ties which allow said power tong to move in a generally horizontal plane.

Preferably, said ties are attached to separate and distinct points of attachment on said support member. However, they could also be attached to a common fitting on said support member. Positioning the ties at the separate and distinct locations has the advantage that, in use, the ties inhibit the tong turning as it applies torque to the casing.

Advantageously, said ties are attached to said support member substantially directly above their points of attachment to said power tong.

Preferably, said ties comprise wire cables although they could also comprise, for example ropes and/or rods.

Advantageously, said ties comprise springs so that said power tong is capable of movement in a horizontal plane.

Preferably, said automatic torque wrenching machine includes a hydraulic operator connected to said pneumatic operator whereby said pneumatic operator can be raised and lowered to a desired datum level.

The present invention also provides an automatic torque wrenching machine for coupling and uncoupling threaded lengths of pipe, said automatic torque wrenching machine comprising:

(a) a back-up tong for gripping a first length of pipe;
(b) a power tong for gripping a second length of pipe and rotating said second length of pipe relative to said first length of pipe;
(c) means connecting said power tong and said backup tong to transmit reaction forces from said power tong to said back-up tong;
(d) means for moving said power tong towards and away from said back-up tong;
(e) a frame; and
(f) a support member;

the improvement comprised in that:

(g) said power tong is supported from said support member by at least three ties which are attached to separate and distinct points of attachment on said power tong and on said support member; and
(h) a pneumatic operator is connected to said frame and said support member whereby said support member can be raised and lowered relative to said frame.

Preferably, said ties are attached to said support member substantially directly above their points of attachment to said power tong.

Advantageously, said ties comprise wire cables.

Preferably, said ties also comprise springs so that said power tong can move in a horizontal plane.

For a better understanding of the invention reference will now be made, by way of example, to the accompanying drawings, in which

DETAILED DESCRIPTION OF THE PREFERRED EMBODIMENTS

Figure 1:
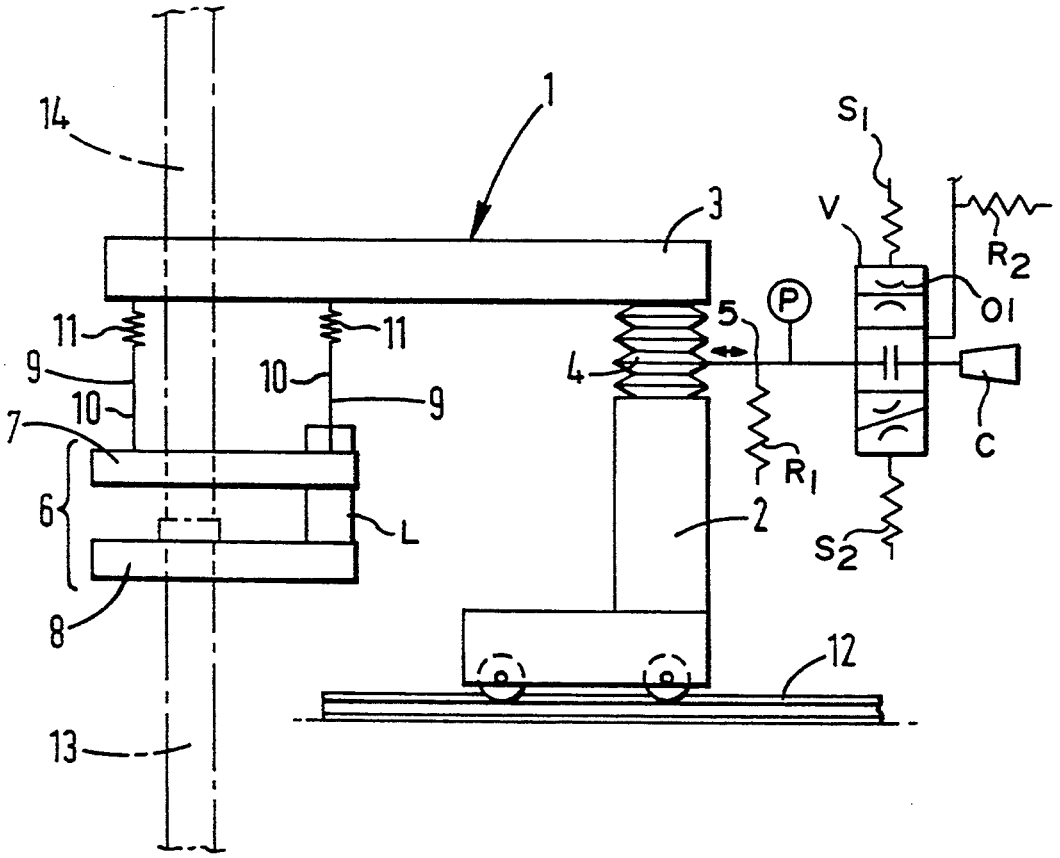
FIG. 1 shows a simplified side view of one embodiment of an automatic torque wrenching machine in accordance with the invention.

Referring to FIG. 1, there is shown an automatic torque wrenching machine which is generally identified by reference numeral 1. The automatic torque wrenching machine 1 comprises a frame 2 having a support member 3 which can be raised or lowered with respect to said frame 2 by admitting or withdrawing air to a bellows 4 via an air line 5.

Generally, drilling rigs are provided with a convenient supply of compressed air which has been illustrated by compressor C in FIG. 1.

A three position valve V is used to control the flow of air to and from the bellows 4. The valve V is shown in its neutral position to which it is biased by springs S1 and S2 and in which position air can neither flow to or from the bellows 4.

When the valve V is depressed air can flow from the compressor C to the bellows 4 until the pressure in the bellows 4 reaches a pressure at which the adjustable pressure relief valve R1 vents. The valve V is provided with a first orifice 01 to restrict the rate at which compressed air can flow into the bellows 4 from the compressor C.

When the valve V is raised air can flow from the bellows 4 to the adjustable pressure relief valve R2 which is set to open at a pressure lower than the adjustable pressure relief valve R1 for a reason which will be described hereinafter.

A conventional tong assembly 6 comprising a power tong 7 and a back-up tong 8 is suspended from the support member 3 by four ties 9 which each include a length of wire rope 10 and a spring 11.

The back-up tong 8 is provided with an upwardly extending pillar L on which the power tong 7 is slidably mounted so that the power tong 7 and the back-up tong 8 can be moved towards and away from one another. The pillar L serves to transmit reaction forces from the power tong 7 to the back-up tong 8 as is well known in the art. A cap is mounted on the top of the pillar L and serves to prevent separation of the back-up tong 8 from the power tong 7 so that the back-up tong 8 can be suspended from the power tong 7.

The frame 2 is mounted on rails 12.

As shown in FIG. 1, casing is being lowered into a well. The lower casing 13 is held by slips (not shown). The upper casing 14 is then lowered using a block and tackle (not shown) until the threaded pin on the upper casing 14 just enters the socket on the lower casing 13. The upper casing 14 is held in axial alignment with the lower casing 13 by positioning means (not shown) on the drilling derrick.

Frame 2 is then moved to the left on rails 12 until the lower casing 13 is within the back-up tong 8 and the upper casing 14 is within the power tong 7. The back-up tong 8 is then actuated to grip the lower casing 13.

Air is then admitted through airline 5 by depressing valve V to raise the support member 3. The support member 3 raises the power tong 7 relative to the back-up tong 8 which is then actuated to grip the upper casing 14. The support at the top of the upper casing 14 is then relaxed so that a substantial proportion of the entire weight of the upper casing 14 is supported by the power tong 7.

Air is then released from the bellows 4 via the airline 5 to a predetermined pressure determined by adjustable pressure relief valve R2 to allow the threaded male portion (the "pin") on the lower end of the upper casing 14 to advance the threaded socket on the upper end of the lower casing 13.

As the upper casing 14 is lowered the power tong 7 is actuated to rotate the upper casing 14. As the thread on the upper casing 14 engages the thread on the socket of the lower casing 13 the upper casing 14 is pulled downwardly. In view of the resilience of the pneumatic support the threaded connection is made smoothly and efficiently.

The predetermined pressure in the bellows 4 (determined by the adjustable pressure relief valve R2) is set so that in the event that the pin does not mesh with the threads of the socket the downward force of the upper casing 14 is insufficient to appreciably damage the threads of the socket. If desired the adjustable pressure relief valve R2 may be adjusted to reduce the pressure in the bellows 4 as the pin penetrates the socket.

It will be appreciated that the exact position of the longitudinal axis of the lower casing 13 may vary slightly as the casing is run. In addition, the lower casing 13 may sway back and forth in heavy seas. The ties 9, in combination with the springs 11, allow the entire tong assembly 6 to swing in a generally horizontal path so that, in effect, the tong assembly 6 forms part of the casing string and is isolated from relative movements of the frame 2.

Referring now to FIGS. 2 to 5, there is shown an automatic torque wrenching machine which is generally identified by the reference numeral 101. The automatic torque wrenching machine 101 comprises a frame 102 which is provided with a support member 103 having a horizontal portion 103*h* and a vertical portion 103*v*. The support member 103 can be raised and lowered relative to the frame 102 by means of an hydraulically operated piston and cylinder assembly 104*a* and a bellows 104 which is connected to a source of compressed air by an air line 105 and control arrangement similar to that shown in FIG. 1.

A power tong 107, forming part of a tong assembly 106, is suspended from the horizontal portion 103*h* of the support member 103 by four ties 109 each comprising wire ropes 110 which are separated from the support member 103 at their upper ends by springs 111.

Figure 5:
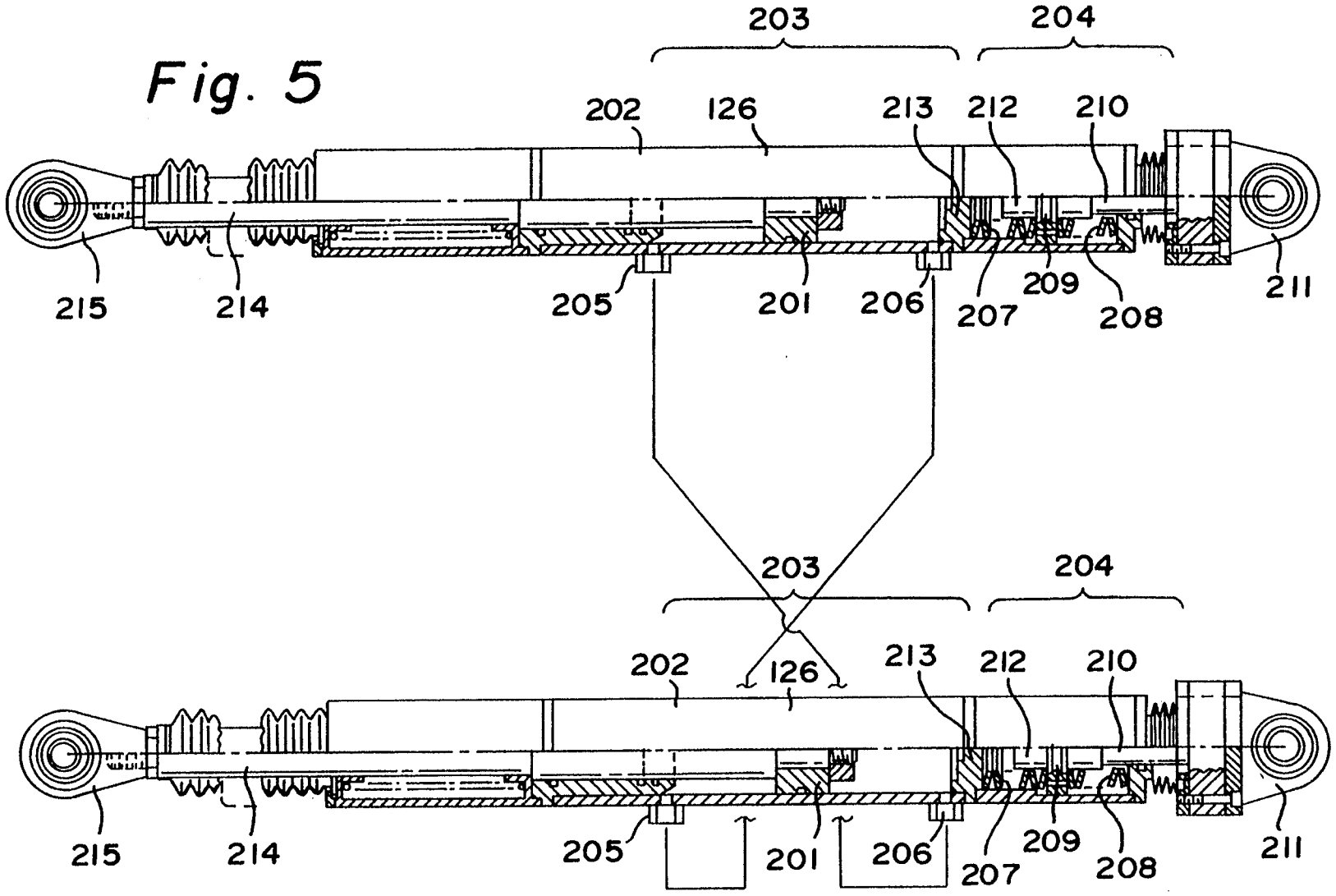
FIG. 5 is a top view, partly cut-away, showing details of the hydraulic piston and cylinder assemblies supporting the power tong in the automatic torque wrenching machine shown in FIGS. 2, 3 and 4.

The power tong 107 is also connected to the vertical portion 103*v* of the support member 103 by two double acting hydraulic piston and cylinder assemblies 126 each of which is shown in more detail in FIG. 5 and is also described in assignees U.S. Pat. No. 5,161,438.

In particular, each double acting hydraulic piston and cylinder assembly 126 comprises a piston 201 which is mounted in a cylinder 202. The cylinder 202 is divided into an hydraulic section 203 and a mechanical section 204. The hydraulic section 203 is provided with ports 205, 206 for the admission and discharge of hydraulic fluid and the mechanical section 204 has packing in the form of cup springs 207, 208 disposed to either side of a piston 209 having a shaft 210 fast with an end fitting 211. The piston 209 has a short extension 212 which can engage a wall 213 separating the hydraulic section 203 from the mechanical section 204. The piston 201 is connected to a shaft 214 which is screwed to an end fitting 215.

Figure 2:
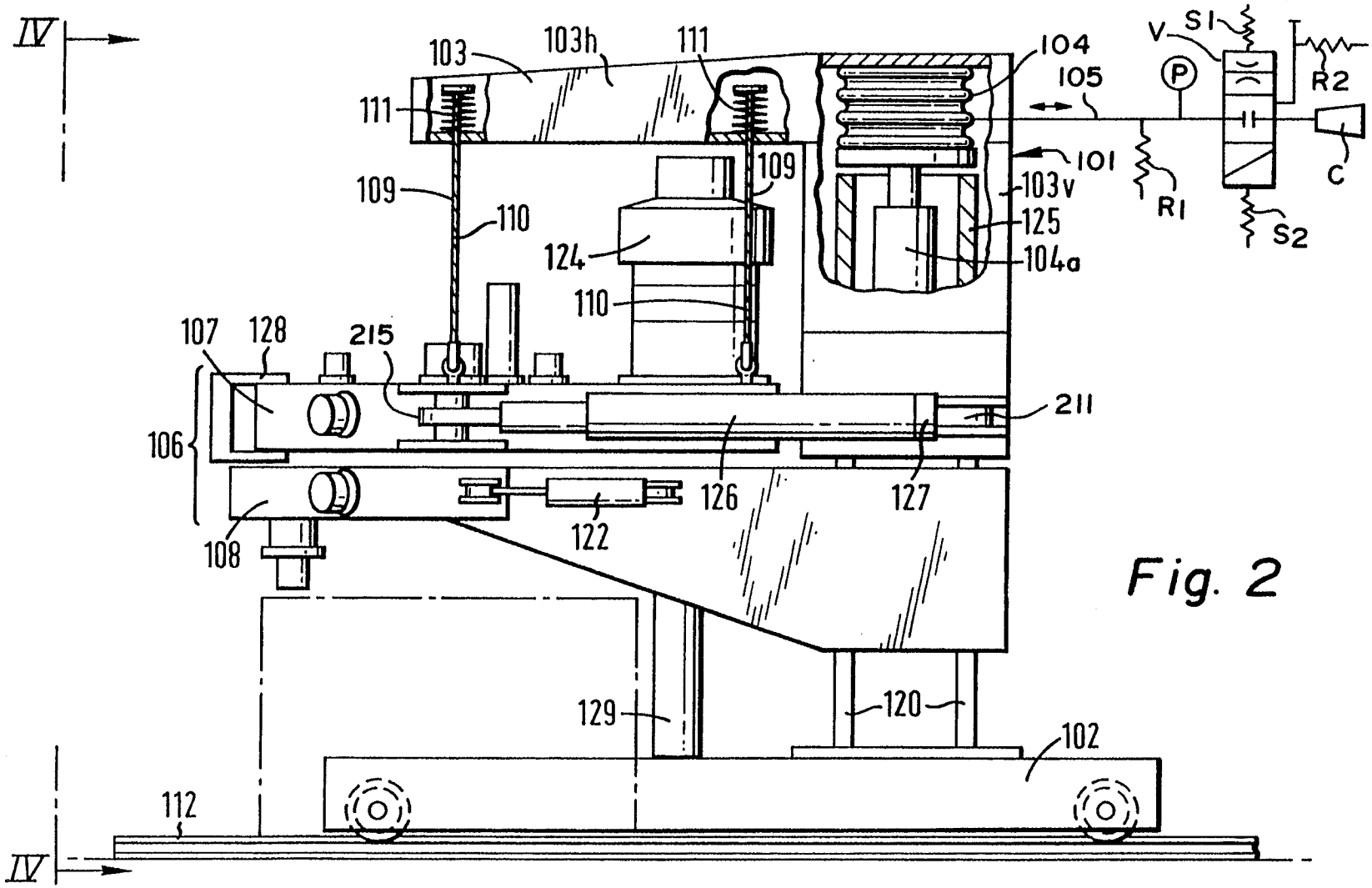
FIG. 2 is aside view of a second embodiment of an automatic torque wrenching machine in accordance with the invention.

As shown in FIG. 2, end fitting 215 is pivotally connected to the power tong 207 whilst the other end fitting 211 is pivotally connected to the vertical portion 103*v*.

As shown in FIG. 5, the cylinders of the double acting hydraulic piston and cylinder assemblies are cross-coupled. In particular, each port 205 of each double acting hydraulic piston and cylinder assembly 126 is connected to the port 206 of the other double acting hydraulic piston and cylinder assembly. The principle is similar to that disclosed in FIG. 4 of assignees U.S. Pat. No. 5,081,888.

In normal use the hydraulic section 203 is kept full of hydraulic fluid so that the piston 201 is effectively locked with respect to cylinder 202. However, the arrangement in the mechanical section 204 together with the pivotal mounting of the end fittings 211 and 215, and the resilience provided by the bellows 104 effectively allows the power tong 107 limited "floating" movement in the x, y and z axis.

The support member 103 is slidably mounted on a torque member 125 comprising a beam of generally "I" shape cross-section having a massive central section provided with four flanges 120. The torque member 125 supports the hydraulic piston and cylinder assembly 104*a* which in turn supports the bellows 104. The support member 103 is vertically movable with respect to the torque member 125 but is constrained against pivotal movement relative thereto.

The back-up tong 108 is also slidably mounted on the torque member 125 and can be raised and lowered by a hydraulic jack 129.

Both the power tong 107 and the back-up tong 108 are provided with doors which can be opened to permit the entrance of a casing. The door of back-up tong 108 can be opened and shut by a hydraulic piston and cylinder assembly 122 whilst the door 128 of the power tong 107 is actuable by a similar piston and cylinder assembly (not shown).

This arrangement has the disadvantage that the back-up tong 108 is NOT free floating. However, it has the advantage that the back-up tong 108 can be used to support a certain length of casing without the need for slips. In addition, in many instances there is little to be gained by making the back-up tong free floating.

In a disconnecting operation the door 128 on the power tong 107 and the door on the back-up tong 108 are opened and the frame 102 advanced on rails 112 so that the casing is received in the power tong 107 and the back-up tong 108. The doors are then closed and the power tong 107 and the back-up tong 108 actuated to grip the upper casing and the lower casing respectively. Air is then admitted to bellows 104 until adjustable pressure relief valve R1 opens to provide an up thrust to the upper casing.

Hydraulic motor 124 is then actuated to unscrew the joint. During the unscrewing operation the power tong 107 tends to pivot anti-clockwise as viewed in FIG. 3. This movement is resisted inter alia by the ties 109. When the joint eventually separates the upper casing is immediately lifted clear of the socket in the lower casing by the bellows 104 to inhibit the thread of the upper casing swinging into the lower casing and damaging the thread on the pin.

Figure 3:
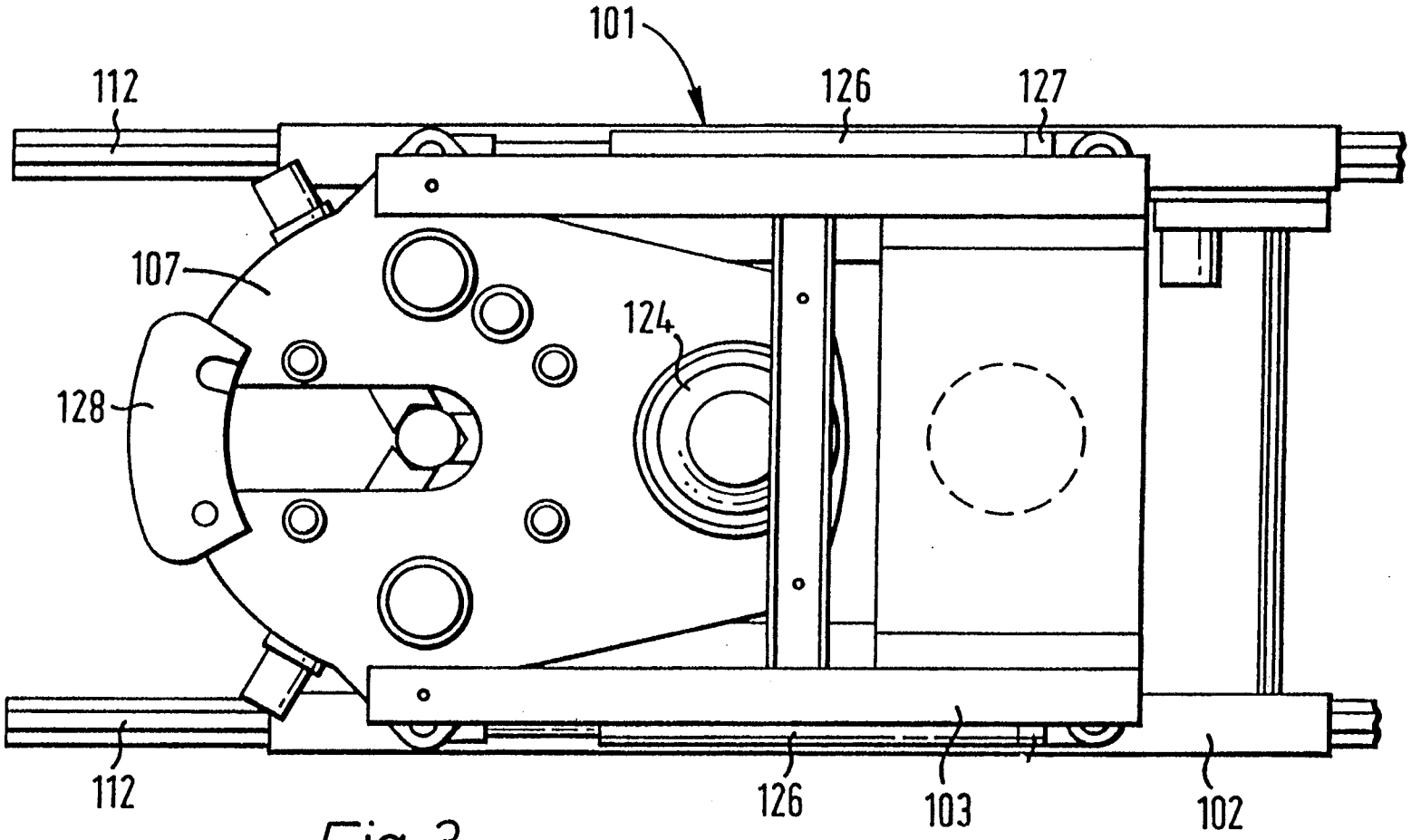
FIG. 3 is a top plan view of the automatic torque wrenching machine shown in FIG. 2.
Figure 4:
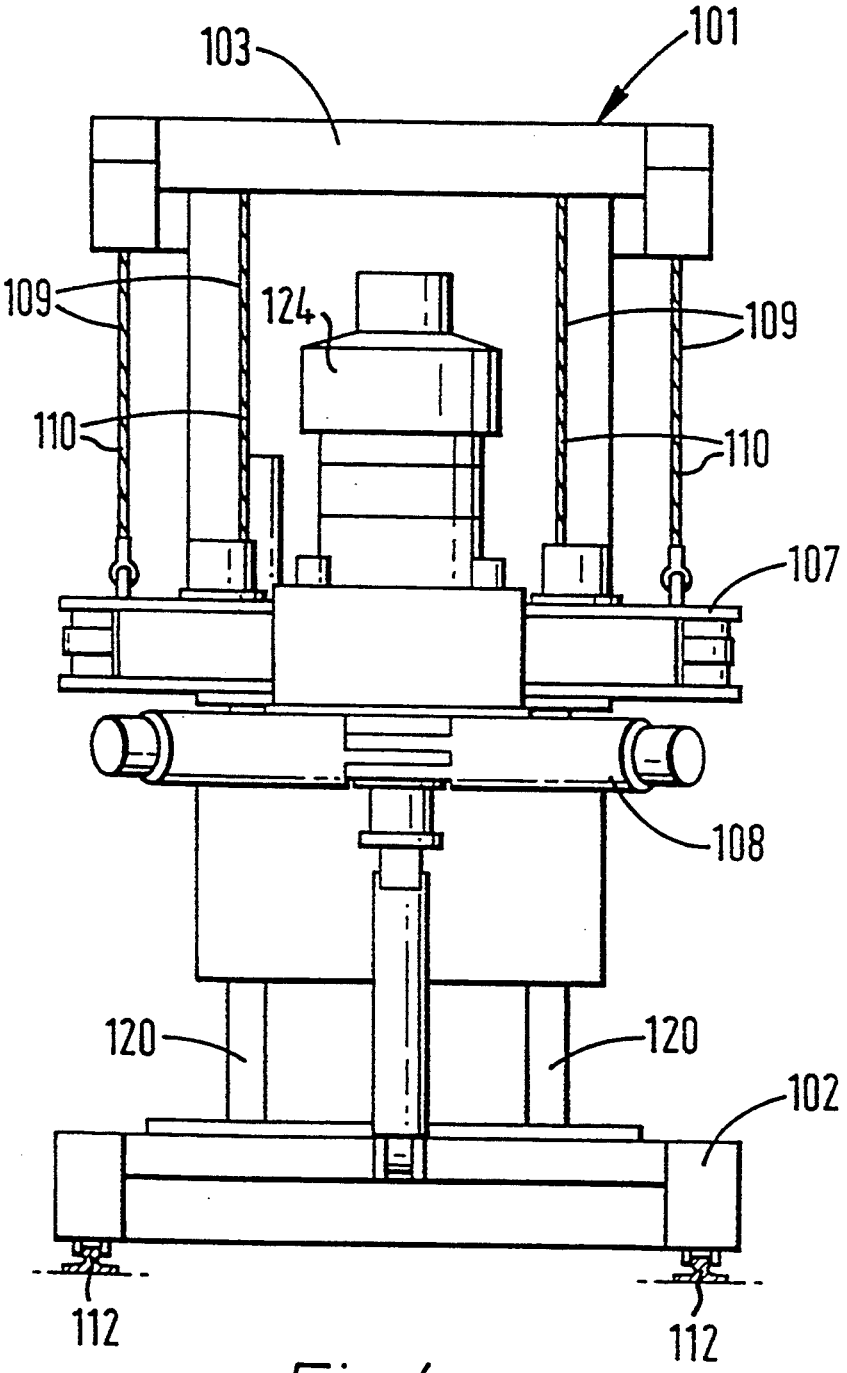
FIG. 4 is a view taken in the direction of the arrows IV—IV in FIG. 2.

In the embodiment shown in FIGS. 2–4, the bellows 104 is supported on a hydraulic piston and cylinder 104*a* operable to set a datum level for the support member 3.

Typically, the power tong of an automatic torque wrenching machine will weigh between 2 and 3 tonnes and be capable of handling pipes with diameters of at least 200mm, more usually at least 300mm and almost invariably 10 up to 500mm.

Various modifications to the embodiments described are envisaged, for example, the bellows could be replaced by any other form of pneumatic operator, for example a pneumatically operated piston and cylinder assembly.

What is claimed is:

1. An automatic torque wrenching machine for coupling and uncoupling threaded length of pipe, said automatic torque wrenching machine comprising a back-up tong for gripping a first length of pipe, a power tong for gripping a second length of pipe and rotating said second length of pipe relative to said first length of pipe, adjustable means connected to said power tong for adjustably and controllably moving said power tong towards and away from said back-up tong, said means for adjustably and controllably moving said power tong towards and away from said back-up tong comprising a pneumatic operator, means for admitting gas to said pneumatic operator to increase the pressure therein and move said power tong with respect to said back up tong, a hydraulic operator connected to said pneumatic operator whereby said pneumatic operator can be raised and lowered to a desired datum level, and means for allowing gas to leave said pneumatic operator and move said power tong with respect to said back-up tong.

2. The automatic torque wrenching machine of claim 1 wherein said pneumatic operator includes an expandable bellows which expands upon the admission of gas thereinto to raise said power tong away from said back-up tong and which deflates upon the exit of gas therefrom to lower said power tong toward said back-up tong.

3. An automatic torque wrenching machine as claimed in claim 1, including a frame and a support member, characterized in that said power tong is supported from said support member, and said pneumatic operator is connected to said frame and said support member for raising and lowering said support member relative to said frame.

4. The automatic torque wrenching machine as claimed in claim 1, characterized in that said back-up tong is suspended from said power tong.

5. The automatic torque wrenching machine as claimed in claim 3, characterized in that said power tong is supported by at least three ties which allow said power tong to move in a generally horizontal plane.

6. The automatic torque wrenching machine as claimed in claim 5, characterized in that said ties are attached to separate and distinct points of attachment on said support member.

7. The automatic torque wrenching machine as claimed in claim 5, characterized in that said ties are attached to said support member substantially directly above their points of attachment to said power tong.

8. The automatic torque wrenching machine as claimed in claim 5, characterized in that said ties comprise wire cables.

9. The automatic torque wrenching machine as claimed in claim 5 further comprising springs interconnected with said ties for moving said power tong in a horizontal plane.

10. The automatic torque wrenching machine as claimed in claim 1, including means connecting said power tong and said back-up tong to transmit reaction forces from said power tong to said back-up tong.

11. The automatic torque wrenching machine as claimed in claim 10 wherein said power tong is movable toward and away from said back-up tong on said means connecting said power tong and said back-up tong.

12. The automatic torque wrenching machine as claimed in claim 1 further comprising a support member, said adjustable means connected to said support member and said power tong supported from said support member by at least three ties which are attached to separate and distinct points of attachment on said power tong and on said support member and wherein said ties are attached to said support member substantially directly above their points of attachment to said power tong.

13. The automatic torque wrenching machine as claimed in claim 12, characterized in that said ties comprise wire cables.

14. The automatic torque wrenching machine as claimed in claim 12, further comprising springs interconnected with said ties for moving said power tong in a horizontal plane.

15. An automatic torque wrenching machine for coupling and uncoupling threaded length of pipe, said automatic torque wrenching machine comprising a back-up tong for gripping a first length of pipe, a power tong for gripping a second length of pipe and rotating said second length of pipe relative to said first length of pipe, means connecting said power tong and said back-up tong to transmit reaction forces from said power tong to said back-up tong, means for moving said power tong towards and away from said back-up tong, said means for moving said power tong towards and away from said back-up tong comprising a pneumatic operator, and means for admitting gas to said pneumatic operator to increase the pressure therein, and means for allowing gas to leave said pneumatic operator, and a hydraulic operator connected to said pneumatic operator whereby said pneumatic operator can be raised and lowered to a desired datum level.

* * * * *